United States Patent [19]

Vonnegut

[11] 4,017,208

[45] Apr. 12, 1977

[54] TWO-WAY FLUID METER PUMP

[75] Inventor: Bernard Vonnegut, Guilderland, N.Y.

[73] Assignee: The United States of America as represented by the Secretary of the Navy, Washington, D.C.

[22] Filed: June 13, 1975

[21] Appl. No.: 586,684

[52] U.S. Cl. ..... 415/90; 418/248; 418/153

[51] Int. Cl.[2] ..... F04D 11/00

[58] Field of Search ..... 415/90, 92, 76; 222/345, 368; 101/167, 169; 418/243, 248; 308/9

[56] References Cited

UNITED STATES PATENTS

| | | | |
|---|---|---|---|
| 577,936 | 3/1897 | Verrue | 418/248 |
| 1,205,088 | 11/1916 | Fietsch | 222/368 |
| 1,258,568 | 3/1918 | Howard | 415/90 |
| 1,980,589 | 11/1934 | Acree | 415/90 |
| 2,025,821 | 12/1935 | Nordmarken | 222/368 |
| 2,041,703 | 5/1936 | Gleason et al. | 222/368 |
| 2,351,431 | 6/1944 | Irons | 415/90 |
| 2,625,885 | 1/1953 | Mumma | 418/153 |
| 2,777,394 | 1/1957 | Modrovsky et al. | 415/90 |
| 2,787,244 | 4/1957 | Hickin | 101/169 |
| 2,843,047 | 7/1958 | Korber | 415/90 |
| 2,992,615 | 7/1961 | Fazekas et al. | 415/90 |
| 3,079,867 | 3/1963 | Thomas | 418/248 |
| 3,179,308 | 4/1965 | Yordi | 222/368 |
| 3,278,092 | 10/1966 | Kletschke et al. | 222/368 |
| 3,294,060 | 12/1966 | McIntyre et al. | 101/169 |
| 3,883,262 | 5/1975 | Saile et al. | 415/90 |

FOREIGN PATENTS OR APPLICATIONS

| | | | |
|---|---|---|---|
| 402,961 | 3/1943 | Italy | 415/90 |
| 9,678 | 1843 | United Kingdom | 418/248 |
| 922,121 | 3/1963 | United Kingdom | 418/248 |

*Primary Examiner*—Henry F. Raduazo
*Attorney, Agent, or Firm*—R. S. Sciascia; L. I. Shrago; C. E. Vautrain, Jr.

[57] ABSTRACT

A two-way fluid flow metering pump for accurately measuring the rate of flow of a liquid is disclosed. A section of a cylindrical shaft is disposed in a bearing made of metal or a fairly rigid nondeformable plastic. An indentation or notch is made in a shaft section passing an inlet and outlet in the bearing, and liquid is transported by the indentation or notch from the inlet to the outlet, or vice versa, depending upon the direction of shaft rotation. A rubber or soft plastic seal inserted in an opening in the bearing remote from the inlet and outlet deforms and conforms to the shaft indentation at each rotation so that the liquid is not transported past the seal.

2 Claims, 2 Drawing Figures

TWO-WAY FLUID METER PUMP

This invention concerns fluid meter pumps and, more particularly, a two-way flow measuring and metering pump.

There are a number of instances in laboratory experiments, in commercial production, and in measuring instruments in which it is desirable to measure accurately the rate of flow of a liquid. Although instruments are available to measure such a flow rate in one direction, there are no known devices or methods of obtaining rate of flow information in the reverse flow direction without requiring the introduction of other mechanisms to produce a reversal of flow. The present apparatus and method provides for such a reversal in the same device without requiring additional components such as different flow channels, valves diaphrams, etc.

Accordingly, it is an object of the present invention to provide a method of and means for accurately measuring the rate of flow of a liquid in alternate, opposite directions without requiring additional components or passages in the device or other devices.

Another object of the invention is to provide a small positive displacement pump that is adapted to supply or measure liquid flow in alternate, opposite directions in a simplified flow-through arrangement.

A further object of the invention is to provide for measurement of liquid flow at known flow rates in a simple device in which flow reversal is obtained simply by reversing the direction of rotation of one element of the pump.

Figure 1:
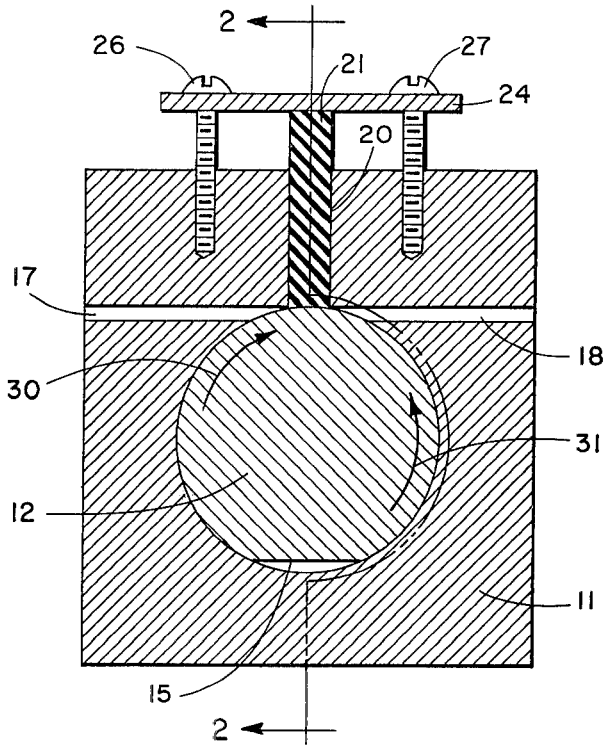
Figure 2:
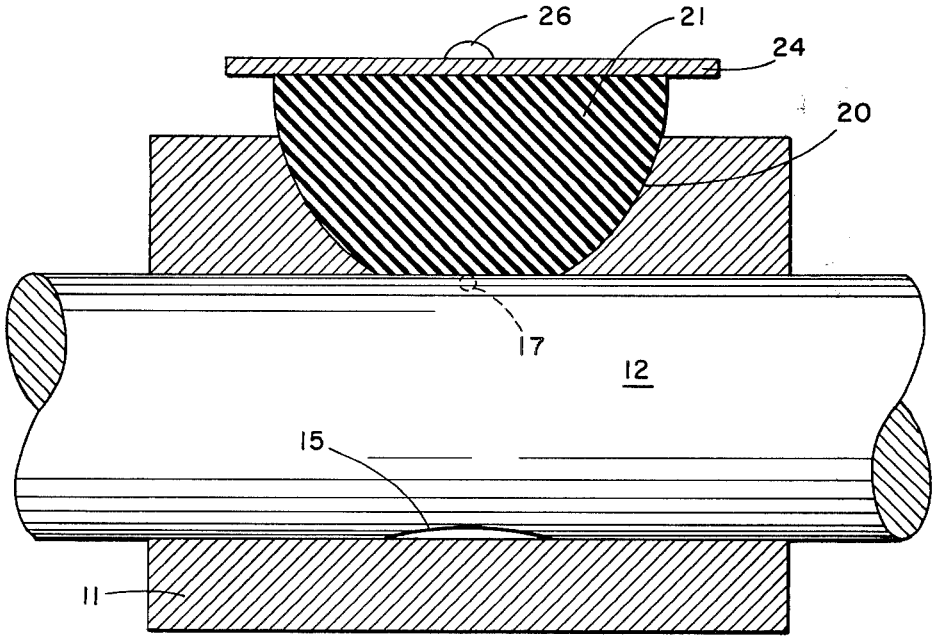

Other objects advantages and novel features of the invention will become apparent from the following detailed description thereof when considered in conjunction with the accompanying drawing in which like numerals represent like parts throughout and wherein:

FIG. 1 is a sectional view of a schematic illustration of the present invention; and FIG. 2 is a sectional view of the invention taken substantially along a line corresponding to line 2—2 in FIG. 1.

The invention, in general, concerns a metering pump in which a cylindrical shaft is disposed in a bearing made of metal or a fairly rigid nondeformable plastic with a very close tolerance between the shaft and bearing to prevent seepage of liquid therebetween. The shaft contains a slight indentation and, at the point in the bearing which this indentation passes, a section of the bearing is replaced by a flexible substance which in effect wipes the indentation clear of liquid and forces the liquid into an adjacent outlet. An inlet on one side of the shaft supplies liquid which is entrained in the indentation during rotation and is forced out of the oppositely positioned outlet by wiping action of the deformable bearing insert. The procedure is completely reversible by simply reversing the direction of rotation of the shaft.

Referring to the drawing, FIGS. 1 and 2 are side and front elevations mainly in section of the two-way pump of the present invention. The pump is formed of a main body 11, which preferably is made of brass or bronze and is the bearing member of the pump, and a shaft 12 which is rotatably mounted in bearing 11 in close tolerance therewith to substantially prevent the passage of liquid therebetween. Shaft 12 preferably is made of stainless steel and is indented as indicated at 15 in a saddleshaped recess for transporting liquid, while bearing 11 has two holes or ports 17 and 18 drilled therein which are the inlet and/or outlet of the pump depending upon the direction of rotation of shaft 12. Bearing 11 is further slotted as indicated at 20 to accommodate a resilient insert 21 which is placed under compression by a plate 24 and two screws 26 and 27 or other conventional tightening means.

Recess 15 is an indentation which conveys liquid about the shaft as the shaft rotates and, as stated infra, is preferably made in the form of a saddle which preferably is formed by filing and then polished so as to make good contact with flexible insert 21. Insert 21 may be made of a variety of durable resilient materials which have rapid recovery from compression and preferably is made of soft rubber of the type used in rubber stoppers for laboratory chemical apparatus. Plate 24 is preferably made of a fairly rigid metal such as iron or steel which will resist bending in regions remote from holding screws 26 and 27. If required, additional screws may be employed to provide greater compression and force direction in resilient member 21.

In operation, resilient insert 21 is prepared so as to fit in slot 20 in a sealing relationship therewith and is of such resiliency as to be forced substantially instantaneously into saddle or indentation 15 when shaft 12 moves the indentation across the base of the insert. When shaft 12 is rotated in a clockwise direction as indicated by arrow 30, slot 15 is wiped clean as it passes under insert 21 and entrains fluid from port 18 making this port the inlet port in this rotation of the shaft. The liquid entrained in indentation 15 is carried around substantially the entire bearing surface in bearing 11 until the indentation reaches port 17 which in this instance is the outlet port of the pump. The fluid entrained in indentation 15 then is wiped from the indentation by insert 21, forcing the liquid as it accumulates to flow out of port 17. At any time, flow may be reversed by reversing the rotation of shaft 12 to the counterclockwise direction indicated by arrow 31. In this stage of operation, liquid in port 17 is entrained in indentation 15, carried around the bearing surface and then wiped out of the indentation when the indentation reaches insert 21.

The two-way pump may be employed in metering liquids between two reservoirs connected by valved lines, not shown, in which the valves would permit discharge of fluid as desired when flow is in either direction through the pump. Additional indentations and resilient inserts in register therewith may be formed and provided in shaft 12 and bearing 11 or in separate units, and their inlets and/or outlets may be joined to provide increased flow rates within the concept of the invention. The pump is particularly useful where the flow rate of a liquid flowing at a steady rate is desired to be determined. It is operable at all flow rates and liquid pressures which are within the response or recovery parameter of the resilient insert. It has been determined that flow rates on the order of from $10^{-6}$ to $10^{-4}$ liters per second can be obtained using a soft rubber insert and a liquid such as water. Soft plastic or other materials such as teflon may also be used to form insert 21. The unit volume of flow, or optimum operating speeds, depend upon both the type of liquid to be metered and the material of which insert 21 is made.

There is thus provided a simply constructed positive displacement pump that is particularly adapted for supplying and/or measuring the flow of a liquid in either of two opposite directions. The feature of a single indentation or a plurality of indentations in a shaft in a symmetrical pump or pumps having interconnected inlets and/or outlets permits instant reversal of the direction of flow merely by reversing the direction of rotation of the pump shaft or shafts. The effectiveness of the pump is dependent upon the effectiveness of the seal between the resilient insert and the surface of the rotating shaft with which the insert comes in contact. For laboratory purposes, the limitations as to pressure of fluid and rate of rotation before inefficient transfer of fluid occurs do not affect the utility of the pump. Although greater volumes of liquid may perhaps be transported by very much enlarged ports 17 and 18, the maximum flow rate achieved by a single pump unit is still necessarily directly related to the volume of indentation 15. Hence, the use of larger ports will not increase the capacity of the pump beyond the volume limitations of indentation 15 and its rate of rotation as part of shaft 12.

Obviously many modifications and variations of the present invention are possible in the light of the above teachings. For example, the ports of the pump may be inclined to the facing surfaces of the resilient member, the ports may be positioned at other points around the periphery of the bearing surface than as shown and described, and the number, size and shape of shaft indentations and related resilient inserts may be varied within the inventive concept.

What is claimed is:

1. A reversible pump wherein flow of liquid in a pipeline or other conduit may be reversed by reversing the direction of rotation of a single cylindrical member comprising:

a bearing in block form and an enlarged shaft portion disposed for rotation therein in close tolerance therewith;

at least two passages in said bearing traversing opposite sides thereof, said passages in line and terminating at the apex of the interior surface of said bearing;

a liquid supply and/or discharge line connected to the outer ends of said passages;

at least one recess in the surface of said shaft positioned so as to be symmetrically disposed during rotation thereof with the interior ends of said passages, said recess elliptical in shape and having a depth on the order of the diameter of said passages;

an opening in said bearing in register with and encompassing said shaft recess;

a resilient member in said opening and means for maintaining said resilient member in compression against said shaft portion, said resilient member terminating at and spanning the space between the interior ends of said passages, said member extending exterior to said bearing and said means for maintaining compression disposed outside of and adjustably secured to said bearing; and means for rotating said shaft portion, whereby rotation of said shaft portion in one direction pumps liquid in one direction through said passages and reverse rotation causes flow of liquid in the opposite direction through said passages via transport in said recess terminated by said resilient member.

2. The reversible pump of claim 1 wherein said passages are connected across a conduit through which a liquid is passed at a pulsating flow whose rate is determined by the rate of rotation of said shaft portion.

* * * * *